US006161535A

United States Patent [19]

Dempsey et al.

[11] Patent Number: 6,161,535

[45] Date of Patent: Dec. 19, 2000

[54] METHOD AND APPARATUS FOR PREVENTING COLD SPOT CORROSION IN INDUCED-DRAFT GAS-FIRED FURNACES

[75] Inventors: Daniel Joseph Dempsey, Carmel; Kevin Dale Thompson, Indianapolis, both of Ind.

[73] Assignee: Carrier Corporation, Farmington, Conn.

[21] Appl. No.: 09/407,052

[22] Filed: Sep. 27, 1999

[51] Int. Cl.[7] ..... F24B 7/04

[52] U.S. Cl. ..... 126/110 R; 126/116 A; 126/116 R; 236/11; 431/18

[58] Field of Search ..... 126/110 R, 116 A, 126/116 R; 431/12, 18; 236/11; 165/921

[56] References Cited

U.S. PATENT DOCUMENTS

| | | | |
|---|---|---|---|
| 3,367,408 | 2/1968 | Moreland | 126/110 R |
| 3,912,162 | 10/1975 | Bauer et al. | 236/11 |
| 4,251,025 | 2/1981 | Bonne et al. | 431/12 |
| 4,519,540 | 5/1985 | Boulle et al. | 431/12 |
| 4,547,144 | 10/1985 | Dietiker et al. | 431/12 |
| 4,638,942 | 1/1987 | Ballard et al. | 236/11 |
| 4,648,551 | 3/1987 | Thompson et al. | 236/11 |
| 4,688,547 | 8/1987 | Ballard et al. | 126/116 A |
| 4,729,207 | 3/1988 | Dempsey et al. . | |
| 4,792,089 | 12/1988 | Ballard | 236/11 |
| 4,815,524 | 3/1989 | Dempsey et al. | 236/11 |
| 4,848,314 | 7/1989 | Bentley | 126/116 R |
| 4,860,231 | 8/1989 | Ballard et al. | 236/11 |
| 4,887,767 | 12/1989 | Thompson et al. | 236/11 |
| 4,976,459 | 12/1990 | Lynch | 236/11 |
| 5,022,460 | 6/1991 | Brown | 236/51 |
| 5,248,083 | 9/1993 | Adams et al. | 236/11 |
| 5,326,025 | 7/1994 | Dempsey et al. | 236/11 |
| 5,331,944 | 7/1994 | Kujawa et al. . | |
| 5,346,924 | 9/1994 | Rieke et al. | 126/110 R |
| 5,379,752 | 1/1995 | Virgil, Jr. et al. . | |
| 5,492,273 | 2/1996 | Shah | 236/11 |
| 5,590,642 | 1/1997 | Borgeson et al. | 236/11 |
| 5,732,691 | 3/1998 | Maiello et al. | 126/116 A |
| 5,791,332 | 8/1998 | Thompson et al. | 126/116 A |
| 5,806,760 | 9/1998 | Maiello | 236/11 |
| 5,819,721 | 10/1998 | Carr et al. | 126/116 A |
| 5,865,611 | 2/1999 | Maiello | 126/116 A |
| 6,000,622 | 12/1999 | Tonner et al. | 236/11 |

*Primary Examiner*—Ira S. Lazarus
*Assistant Examiner*—David Lee
*Attorney, Agent, or Firm*—Wall Marjama & Bilinski

[57] ABSTRACT

A method and apparatus for increasing the circulating airflow of induced-draft, gas-fired multi-stage furnaces without creating conditions that result in cold spot corrosion therein. Control circuitry is provided to selectably increase the circulating airflow of the furnace during low stage operation. The control circuitry is arranged so that increases in the magnitude of the circulating airflow of the furnace are accompanied by predetermined increases in the magnitude of the combustion airflow of the furnace. The magnitudes of the circulating and combustion airflows are so related to one another that the temperature at the output of the heat exchanger is maintained at a value which is approximately constant, and which is high enough to assure that water cannot condense thereon. The control circuitry may include a relay or relay-like device that is connected to prevent the high stage solenoid of the gas valve from becoming actuated during low stage operation.

21 Claims, 4 Drawing Sheets

METHOD AND APPARATUS FOR PREVENTING COLD SPOT CORROSION IN INDUCED-DRAFT GAS-FIRED FURNACES

BACKGROUND OF THE INVENTION

The present invention relates to furnaces, and is directed more particularly to a method and apparatus for increasing the circulating airflow of induced-draft gas-fired furnaces without creating conditions that can result in cold spot corrosion therein.

Furnaces which are of the multi-stage type, i.e., which have two or more stages or firing rates, are ordinarily designed to circulate a fixed quantity of air per unit time through the space to be heated when they are operating at their lowest stage or firing rate. This quantity of air, usually referred to as the circulating airflow of the furnace, is selected not only to maximize the furnace comfort provided to the heated space, but also to optimize the sound level resulting from the operation of the furnace and the durability or useful life of the furnace as a whole. Even the most carefully designed furnaces, however, cannot realize their full potential if they are used to heat spaces that have poorly designed duct systems. Since the inadequacies of duct systems are often not apparent until after they have been installed, and since duct systems can be expensive to modify once they have been installed, heating contractors often try to compensate for the inadequacies of duct designs by increasing the circulating airflow which the furnace establishes when it operates at its lowest stage or firing rate. Heating contractors may take similar measures to deal with duct inadequacies in single stage furnaces.

Operating a furnace at a circulating airflow value which is greater than the circulating airflow value for which it was designed can, however, adversely affect the useful life thereof. This is because increasing the circulating airflow of a furnace has the effect of decreasing the temperature of the walls of the heat exchanger thereof. If the decrease in wall temperature is relatively large, it can allow water to condense on the walls of the heat exchanger, particularly near the outlet end thereof. In furnaces which include secondary or condensing heat exchangers, water can condense on the walls of the coupling box which connects the primary heat exchanger to the secondary heat exchanger even when the increase in circulating airflow is relatively small. This condensed water, in turn, can cause the walls of the primary heat exchanger and/or coupling box to corrode, a condition commonly known as "cold spot" corrosion.

In view of the foregoing, it will be seen that, prior to the present invention, the problem of "cold spot" corrosion has limited the extent to which the circulating airflow of furnaces could be increased in order to offset inadequacies in the designs of their duct systems.

SUMMARY OF THE INVENTION

In accordance with the present invention there is provided a method and apparatus that allows the circulating airflow of furnaces to be increased without creating conditions that result in cold spot corrosion.

The present invention is based on the recognition that the circulating airflow of a furnace can be increased, without causing the temperature within the heat exchanging elements of that furnace to fall to a value low enough for water to condense therein, if the increase in circulating airflow is accompanied by an increase in the inducer or combustion airflow of that furnace. In preferred embodiments of the invention the increases in circulating and combustion airflow are so related to one another that the temperature at the outlet of the heat exchanger is maintained at a predetermined temperature which is approximately constant and which is high enough to assure that water cannot condense thereon. The various embodiments of the present invention differ from one another primarily as a result of differences in the ways in which the magnitude of the circulating airflow may be selected or adjusted by the user, differences in the manner in which the desired relationship between the circulating and combustion airflows are established, and differences in the ways in which they deal with limits on the range of circulating airflows over which they may be adjusted.

When the present invention is used with multi-stage furnaces, the range over which the circulating airflow may be adjusted is limited by the requirement that the differential pressure which the flow of combustion air establishes across the heat exchange system of the furnace remain below the differential pressure at which the high pressure switch actuates. In such cases, the range over which the combustion airflow may be adjusted may be increased by increasing the actuation pressure of the high pressure switch. Since such modifications to a furnace are ordinarily undesirable, such applications of the invention are not preferred applications thereof .

In preferred embodiments of the invention, the range over which circulating airflow may adjusted is not limited to a value which assures that the pressure differential across the heat exchanger (herein often abbreviated to HXDP) remains below the actuation pressure of the high pressure switch. In embodiments of this type, an excursion of HXDP above the actuation pressure of the high pressure switch may be permitted if the furnace control includes or is modified to include hardwired circuitry, such as a disabling or disengaging relay, which introduces a suitable time delay between the time that the high pressure switch is actuated and the time that the furnace acts on this actuation. An example of a furnace which uses a disabling relay for this purpose is described in U.S. Pat. No. 5,379,752 (Virgil et al), which is hereby incorporated herein by reference. Alternatively, the stored program of the furnace control may be modified to distinguish between transient and steady state pressure excursions, and to ignore transient pressure excursions that have less than a predetermined duration. All such embodiments and equivalents thereof that would be apparent to those skilled in the art will be understood to be within the contemplation of the present invention.

For all of the above-mentioned types of embodiments, the magnitude of the circulating airflow that the furnace establishes when it operates at low stage may be selected or adjusted in a variety of ways. This level may, for example, be selected manually, at the furnace, by selecting particular combinations of the switch positions made available by a switch, such as a DIP switch, which is included in the furnace control circuitry. The level of circulating airflow may also be selected manually, at a thermostat, by moving the control lever of the thermostat through a predetermined sequence of positions as a function of time, as described in copending, commonly assigned U.S. patent application Ser. No. 09/208,502, filed Dec. 9, 1998, which is hereby incorporated herein by reference. Other devices and techniques for selecting or adjusting the magnitude of the circulating airflow will be apparent to those skilled in the art, and will be understood to be within the contemplation of the present invention.

Finally, for each of the above-discussed embodiments, the desired relationship between the circulating and combustion airflow levels may be established and maintained in a variety of different ways. In furnaces in which both the blower and the inducer motors can be driven at continuously variable speeds, this relationship is preferably established by maintaining a predetermined ratio between the speeds at which the blower and inducer motors are driven, or by otherwise causing the inducer speed to be a predetermined ratio or function of the blower speed. The magnitude of this ratio or, equivalently, the nature of this function will be understood to comprise an important part of the present invention.

In furnaces in which one or both of the blower and inducer motors can be driven only at selected ones of a plurality of fixed speeds, the above mentioned ratio or function may be approximated by causing the blower and inducer motors to operate at appropriate combinations of the available fixed speeds. Since embodiments of this type produce results which only approximate the results contemplated by the present invention, such embodiments are not preferred embodiments thereof.

Other objects and advantages of the present invention will be apparent from the following description and drawings, in which:

DESCRIPTION OF THE PREFERRED EMBODIMENTS

Figure 1:
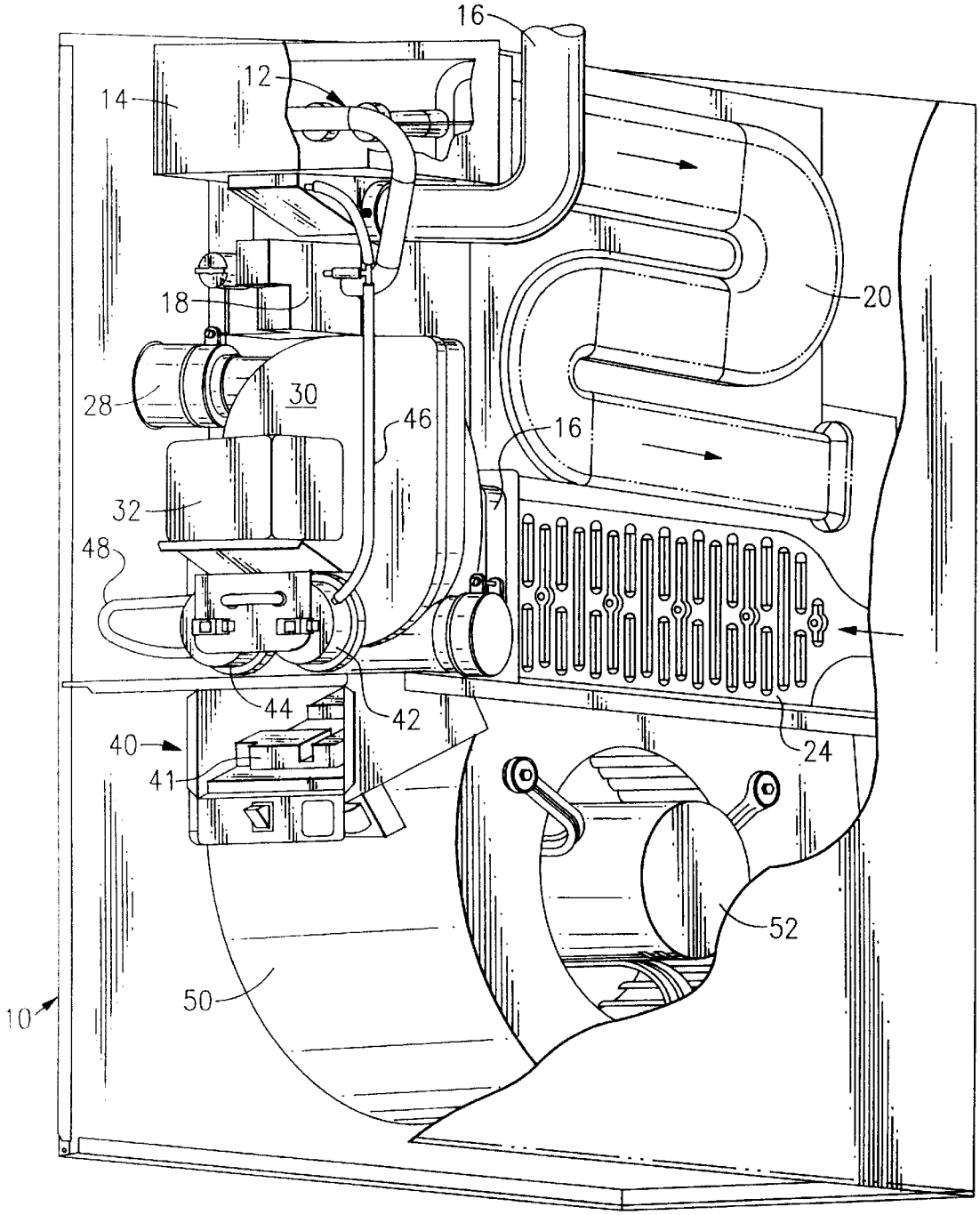
FIG. 1 is cutaway, oblique view of a furnace suitable for use with the method and apparatus of the present invention.

Referring to FIG. 1, there is shown a furnace 10 which is of a type suitable for use with the present invention, namely: a two-stage condensing furnace. Furnace 10 includes a burner assembly 12 that is located within a burner box 14 and is supplied with air via a duct 16. The gases produced by combustion within burner box 14 flow through a primary heat exchanger 20, a coupling box (not visible in FIG. 1), a secondary or condensing heat exchanger 24, and a collector box 26, before being vented to the atmosphere through an exhaust vent 28. The flow of these gases, herein called combustion air, is maintained by an inducer blower 30 which is driven by an inducer motor 32 in response to control signals from a furnace control assembly 40 which is, in turn, responsive to the states of a low pressure switch 42 and a high pressure switch 44. Fuel gas is supplied to burner assembly 12 through a gas valve 18, and is ignited by an igniter assembly (not shown). Condensed water accumulating within collector box 26 is drained to a sewer line or the like through a condensate drain line (not shown).

Air from the space to be heated is drawn into furnace 10 by a blower 50 which is driven by a suitable blower motor 52 in response to signals received from either its own internal microprocessor, or from a furnace control circuit 41 that is included in furnace control assembly 40. The discharge air from the blower 50, herein called circulating air, passes over condensing heat exchanger 24 and primary heat exchanger 20, in counterflow relationship to the flow of combustion air, before being directed to the space to be heated through a duct system (not shown).

Because furnace 10 is a multi-stage furnace, inducer motor 32 and blower motor 52 must each be able to operate at a low speed when the furnace is operating at its low firing rate (low stage operation) and at a high speed when the furnace is operating at its high firing rate (high stage operation). In furnace 10, motors 32 and 52 are preferably motors that are designed to operate at a continuously variable speed, and are made to operate at their low and high speeds in response to speed control signals generated by furnace control circuit 41. Motors 32 and 52 may each, for example, comprise Electronically Commutated Motors (ECMs) of the type discussed in U.S. Pat. No. 4,729,207 (Dempsey et al), or Integrated Control Motors (ICMs) of the type described in U.S. Pat. No. 5,331,944 (Kujawa et al), both of which are hereby expressly incorporated herein by reference. As explained in the latter patents, the furnace controls which are used with these types of motors preferably not only control the steady state low and high operating speeds thereof, but also the times and the rates or torques at which they accelerate to and decelerate from these operating speeds.

As is well known to those skilled in the art, the combustion efficiency of an induced-draft gas-fired furnace is optimized by maintaining the proper ratio of the gas input rate and the combustion airflow rate. Generally, the ideal ratio is offset somewhat for safety purposes by providing for slightly more combustion air (i.e., excess air) than that required for optimum combustion efficiency. In the furnace of FIG. 1, the excess air level is kept within acceptable limits in part by low and high pressure switches 42 and 44, respectively, which cause inducer motor 32 to run at speeds that are related to the differential pressure or pressure drop across the heat exchanger system thereof. To the end that this may be accomplished, low and high pressure switches 42 and 44 are connected to burner box 18, through a pressure tube 46, to sense a pressure that approximates that at the inlet of primary heat exchanger 20, and are connected to collector box 26, through a pressure tube 48, to sense a pressure that approximates that at the outlet of secondary heat exchanger 24. Because pressure switches 42 and 44 are of commercially available types, and operate in the manner described in the above-cited Dempsey et al patent, neither the structure nor the operation thereof will be discussed in detail herein.

Figure 2:
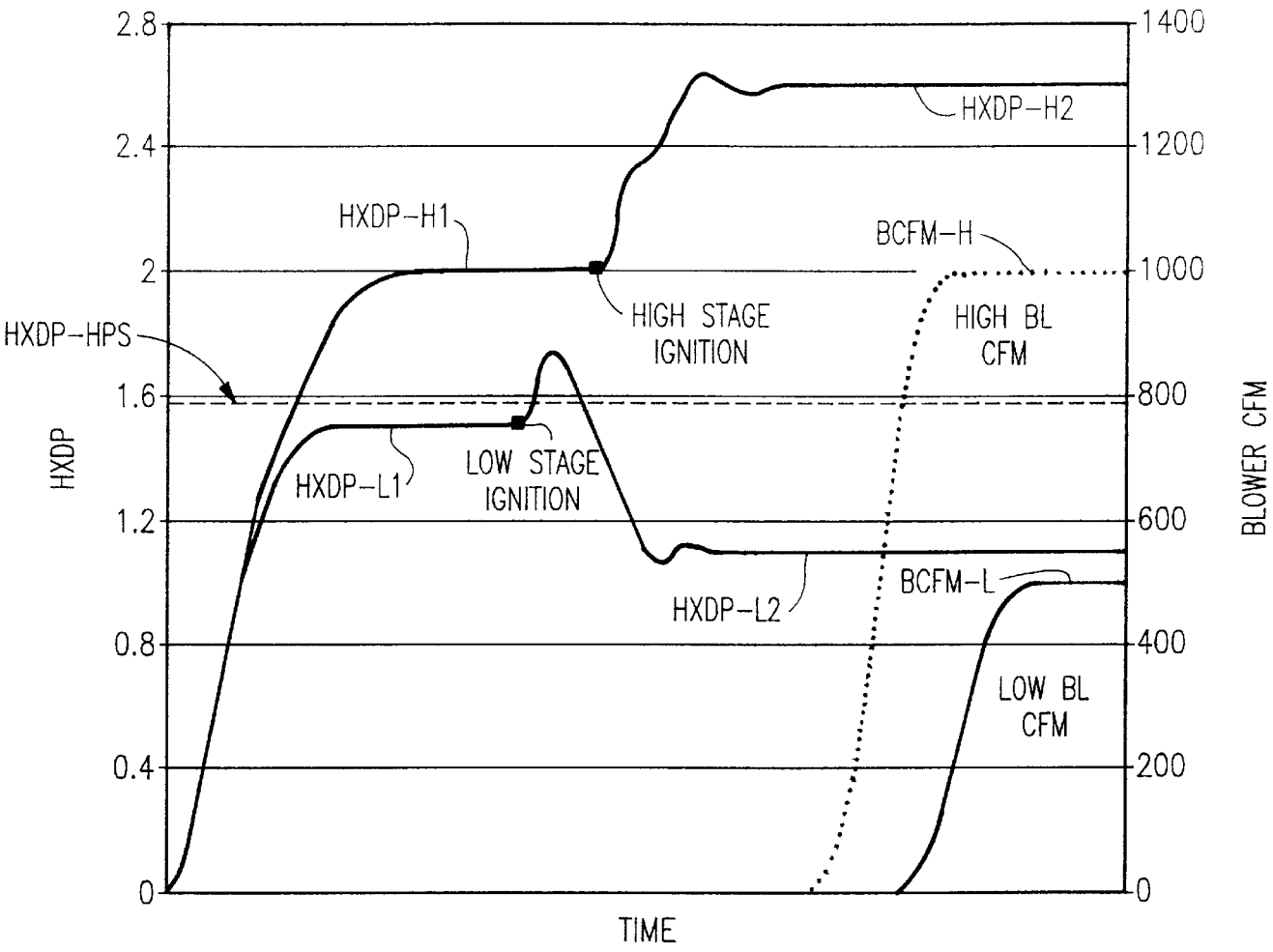
FIG.2 Prior Art
FIG. 2 is a diagram which shows the high stage and low stage differential pressure across the heat exchanger of a furnace of the type shown in FIG. 1 which is not equipped for operation in accordance with the present invention.

Referring to FIG. 2, there is shown a diagram which illustrates the operation of a furnace of the above-described type that does not operate in accordance with the present invention. The diagram of FIG. 2 includes a first vertical axis, labeled HXDP, which shows, for both low and high stage furnace operation, the differential pressure which the flow of combustion air creates across heat exchanger system 20–24, and a horizontal axis which shows the time elapsed since the last call for heat. The diagram of FIG. 2 also includes a second vertical axis, labeled blower CFM, which shows the magnitude of the circulating airflow established by blower 50 plotted against the same horizontal (time) axis.

The furnace operation illustrated in FIG. 2 may be summarized as follows. When there occurs a call for heat at low stage, the furnace control controllably accelerates inducer motor 32 until it attains a pre-ignition steady state speed that corresponds to a heat exchanger differential pressure, HXDP-L1, that is sufficient to actuate low pressure switch 42, but not high pressure switch 44. When this differential pressure has existed for a preset time, valve 18 supplies gas at the low firing rate to burner 12 where it ignites and begins heating the combustion air passing through heat exchange system 20–24. This heating initiates a change in the density of the combustion air which, in turn, causes an increase in the differential pressure across heat exchange system 20–24. The inducer motor speed is then reduced until it attains a steady state speed value that corresponds to a heat exchanger differential pressure, HXDP-L2, that is somewhat lower than its pre-ignition value. Soon after this occurs, the furnace control causes blower motor 52 to accelerate until it reaches a steady state speed that corresponds to the circulating airflow value, BCFM-L, at which furnace 10 is designed to operate at low stage.

Similarly, when there occurs a call for heat at high stage, the furnace control accelerates inducer motor 32 until it attains a pre-ignition steady state speed that corresponds to a heat exchanger differential pressure, HXDP-H1, that is sufficient to actuate high pressure switch 44. When this differential pressure has existed for a preset time, valve 18 supplies gas at the high firing rate to burner 12 where it ignites and begins heating the combustion air passing through heat exchanger system 20–24. This heating initiates a change in the density of the combustion air which, in turn, causes an increase in the differential pressure across heat exchange system 20–24. The inducer motor speed is then increased to attain a steady state speed value that corresponds to a heat exchanger differential pressure, HXDP-H2, that is somewhat higher than its pre-ignition value. Soon after this occurs, the furnace control causes blower motor 52 to accelerate to a steady state speed value that corresponds to the circulating airflow value, BCFM-H, at which furnace 10 is designed to operate.

Since the above-mentioned speeds and differential pressure values, and the manner in which they are determined and established, are discussed in the earlier cited Dempsey et al patent, these speeds and differential pressure values will be discussed herein only to the extent necessary to clarify the nature of the present invention, and how the present invention differs from the invention described in the aforementioned patent.

If a furnace of the type described in connection with FIGS. 1 and 2 is modified so that the magnitude of the circulating airflow which furnace 10 establishes during low stage operation is increased to a value larger than BCFM-L, the amount of heat that the circulating air absorbs and carries away from heat exchange system 20–24 in a given amount of time will increase. This increase in heat absorption, in turn, decreases the temperature of the walls near the outlet end of primary heat exchanger 20 and within the coupling box that connects the latter to secondary heat exchanger 24. If this decrease in temperature is large enough, water will be able to condense in one or both of these places. Under the latter condition, cold spot corrosion can occur, and result in a reduction in the useful life of the furnace. Unfortunately, efficiency considerations require that the circulating airflow level that is established during low stage furnace operation be set at a level just high enough to prevent such condensation. As a result, prior to the present invention, even small increases in the rate at which circulating air flows during low stage operation was not permitted because it would cause condensation and lead to cold spot corrosion.

In accordance with the present invention, it has been discovered that the low stage circulating airflow through a furnace may be increased, without causing condensation and cold spot corrosion, if the combustion airflow there through is also increased. More particularly, it has been discovered that, so long as a predetermined relationship or ratio is maintained between the speeds of the blower and inducer motors, the low stage circulating airflow may be increased without causing the steady state temperatures at the outlet of the primary heat exchanger and/or the coupling box to fall to values that allow condensation to occur. In the preferred embodiment, this predetermined relationship or ratio is selected so that the latter temperatures remain approximately constant as the circulating airflow value changes from its original to its increased value and back again.

Because the mathematical function which expresses the desired relationship between the blower and inducer motor speeds will vary from furnace to furnace, it is not possible to express this relationship in terms that are applicable to all furnaces. The general nature of this relationship may nevertheless be understood from the following specific example. If the furnace is a model 58MVP two-stage gas-fired furnace manufactured by Carrier Corp., the temperatures at the outlet of the primary heat exchanger and the coupling box will remain constant if the speeds of the inducer and blower motors satisfy the following relationship:

$$\text{Inducer Ratio}=0.231+(0.776\times\text{Blower Ratio})$$

If, for example, the blower speed is increased by 10%, the blower ratio will be 1.1 and the inducer ratio will be 1.085. As a result, the inducer speed should be increased by 8.5%. Since the relationship which produces the best results varies from furnace to furnace, it will be understood that the above relationship is only one example of many possible relationships, and that the relationship which is used should be the one which produces the best results for the type of furnace with which the invention is used. Since the blower-inducer speed relationship that best meets the heat exchanger temperature condition contemplated by the present invention may be determined empirically, from measurements performed on the actual furnace and vent system with which it is to be practiced, or from computer models thereof, the theoretical basis for this relationship will not be further discussed herein.

Figure 4:
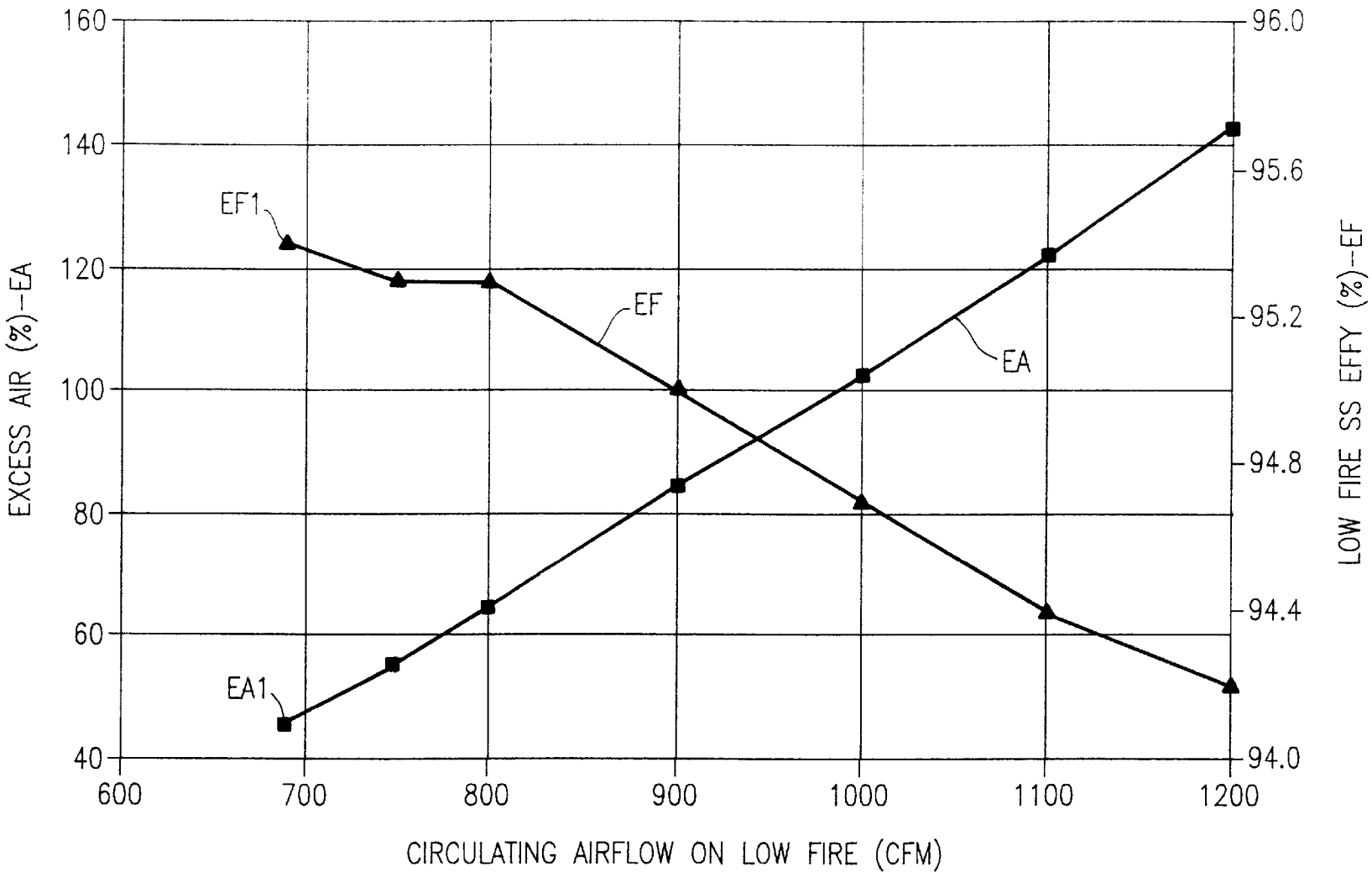
FIG. 4 is a diagram which shows the percentage of excess air and efficiency of the furnace of FIG. 1 plotted as a function of circulating airflow under low fire operating conditions.

As will be apparent to those skilled in the art, an increase in the magnitude of the combustion airflow through a furnace results in an increase in the excess air level and a decrease in the efficiency thereof. Significantly, the increase in excess air level, although large, is unobjectionable because it is in a direction which makes the operation of the furnace more reliable. In addition, the decrease in efficiency of the furnace, although definite, is sufficiently small to be acceptable in all but the most critical applications. Specific examples of how the magnitudes of these variables change with changes in combustion airflow for a Carrier Corp. model 58 MVP furnace are shown in FIG. 4. In FIG. 4, the curve labeled EA indicates the excess air level of the furnace, while the curve labeled EF indicates the efficiency thereof. The points labeled EA1 and EF1 correspond, respectively, to the excess air level and efficiency of the furnace before the circulating and combustion airflows of the furnace are changed in accordance with the present invention. It will therefore be seen that the benefits provided by the present invention are not only significant, but are also provided without having a significant negative impact on other aspects of the operation of the furnace with which the invention is used.

In furnaces that are equipped to practice the present invention, it is preferred that the circulating airflow value be dealt with as an independent variable which the user is free to choose or adjust by means of suitable manually operable control, and that the combustion airflow value be dealt with as a dependent variable which the furnace control establishes automatically once the user's choice or selection has been made. As will be explained more fully presently, the different forms which the present invention may take correspond to differences in the number of airflow values that the user may select, differences in the manner in which the user may select those values, and differences in the ways in which the furnace establishes the corresponding combustion airflow values.

Figure 3:
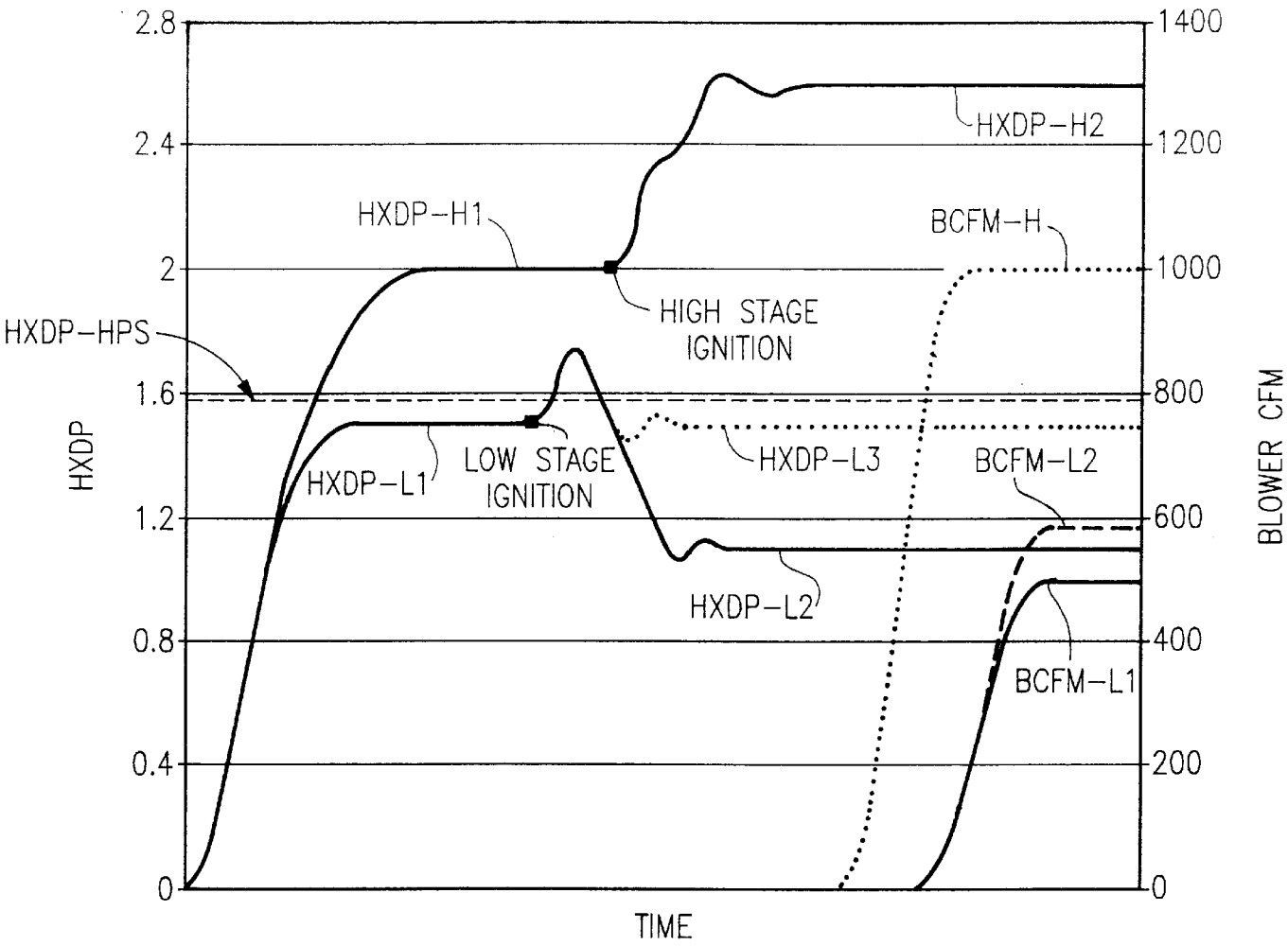
FIG. 3 is a diagram which shows the high stage and low stage differential pressure across the heat exchanger of a furnace of the type shown in FIG. 1 which is equipped for operation in accordance with the present invention.

Referring to FIG. 3, there is shown a diagram which illustrates the operation of a furnace which is of the same general type as that described in connection with FIGS. 1 and 2 above, but which has been modified to operate in accordance with an embodiment of the invention that allows the low stage circulating airflow value of the furnace to be increased in a single step from a low value of BCFM-L1 to a high value of BCFM-L2. In accordance with the invention, this increase is accompanied by an increase in the inducer motor speed that is sufficient to increase the heat exchanger pressure drop from a low value of HXDP-L2 to a high value of HXDP-L3. The magnitude of these increases is limited by the fact that differential pressure HXDP-L3 must not (except as will be explained later) be allowed to exceed the differential pressure, HXDP-HPS, that is associated with the actuation of high pressure switch 44. The magnitude of these increases is also limited by the fact that they decrease the air temperature rise of the furnace, which should not ordinarily be allowed to fall below the minimum air temperature rise shown on the rating plate thereof. If the furnace is a Carrier Corp. model 58MVP furnace, these changes correspond to a blower airflow increase of approximately 18% and an inducer motor speed increase of approximately 15%, and this approximates a 10 degree decrease in the air temperature rise of the furnace.

Furnaces constructed in accordance with the present invention may be arranged so that the user may select the desired increase in low stage circulating airflow in any of a variety of different ways. Furnace control circuit 41 may, for example, be provided with a suitable manually operable switch, preferably a board mounted DIP switch, that allows the user to manually indicate to the furnace control processor whether he wishes the furnace to operate at its lower or higher circulating airflow value. If this embodiment is used, the stored program of the processor should include instructions which cause it to examine the state of this switch and interpret the result as a request to change (or not change) the magnitudes of the speed control signals that it generates and applies to the blower and inducer motors. Since the generation and outputting of such signals is described in the above-cited Dempsey et al patent, these will not be further described herein.

Alternatively, the control processor of furnace control 40 may be programmed to recognize and respond to requests for changes in the low stage circulating airflow which the user may make using the mode control lever of the room thermostat. Such requests may, for example, comprise the movement (or toggling) of the mode control lever from its "fan on" to its "auto" position and back again within a predetermined time. Since furnace controls which are adapted to operate in this manner are described in detail in copending, commonly assigned U.S. patent application Ser. No. 09/208,502, filed Dec. 9, 1998, which has been incorporated by reference herein, embodiments of the present invention which use the thermostat-based technique disclosed in this application will not be described in detail herein.

While both the above-described switch-based embodiment and the above-described thermostat-based embodiment may be used to determine which of two low stage circulating airflow values a furnace will establish, neither of these embodiments are limited to furnaces which establish two and only two such airflow values. Switch-based embodiments may, for example, be expanded to provide more than two different circulating airflow values by using switches which include suitable numbers of switch positions or bits. Similarly, thermostat-based embodiments may be expanded to provide more than two different circulating airflow values by including in the program of the furnace control processor instructions which allow it to recognize sequences of thermostat lever operations as requests that the circulating airflow be stepped through a series of different values. It will therefore be understood that the present invention may be practiced with any furnace which is able to establish two or more different low stage circulating airflow values.

As explained earlier, the range of values over which the low stage circulating airflow of a furnace may be adjusted is limited by the requirement that the differential pressure across the heat exchanger not become high enough to actuate the high pressure switch during low stage operation. Limitations of this type may be reduced in either or both of two ways. A first of these ways is to increase the differential pressure, HXDP-HPS, at which high pressure switch 42 is actuated to a value high enough that the increase in low stage combustion airflow does not cause HXDP-HPS to be exceeded. This approach, while usable, is not preferred because it will reduce the vent length desired for high stage ignition.

A second, preferred way of increasing the amount by which the low stage circulating airflow may be increased is to include, in furnace control circuit 41, a disable relay that is connected to prevent the high stage solenoid of gas valve 18 from becoming actuated during low stage operation. By disabling the high stage solenoid of gas valve 18 during this period, the latter is prevented from being actuated if the differential pressure is above HXDP-HPS during low stage operation. This, in turn, allows the low stage circulating airflow to have a steady state value that produces a heat exchanger differential pressure above HXDP-HPS. An example of how a disable relay may be used to produce this result is described in U.S. Pat. No. 5,379,752 (Virgil et al), which has been incorporated by reference herein.

While the present invention is best suited to use in multi-stage furnaces, it may also be used in single stage furnaces, if those furnaces include, or can be modified to include, motors that have two or more speeds, or speeds that are continuously variable. If, for example, a single stage furnace is equipped (or retrofitted) with a blower motor that has two or more nominally fixed speeds, or a continuously variable speed, the present invention may be practiced if the furnace is also equipped (or retrofitted) with an inducer motor that has two or more nominally fixed speeds or a continuously variable speed, provided that the inducer motor is designed or can be made to operate at speeds that so are related to those of the blower motor that the temperature at the outlet of the heat exchanger is held above the condensation temperature of water. Since the blower- inducer motor speed relationships that assure the holding of the latter temperature have been described in connection with the embodiment of FIG. 3, these relationships will not be discussed again in connection with the present embodiment.

While the present invention has been described with reference to a number of specific embodiments, it will be understood that these embodiments are exemplary only and that the true spirit and scope of the present invention should be determined with reference to the following claims.

What is claimed is:

1. A method for increasing the circulating airflow of a furnace without creating conditions favorable to the occurrence of cold spot corrosion therein, said furnace being of the type which has a first firing rate, a first steady state circulating airflow value, and a first steady state combustion airflow value, said furnace also being of the type which includes a heat exchanger having an inlet and an outlet, a blower, a blower motor for driving said blower, an inducer blower, an inducer motor for driving said inducer blower, and a control circuit for generating a first steady state circulating airflow value, and for generating a first inducer control signal for causing said inducer motor and inducer blower to establish said first steady state combustion airflow value, said method comprising the steps of:

(a.) equipping said control circuit to generate, without changing said firing rate, a second blower control signal for causing said blower motor and blower to establish a second steady state circulating airflow value which is greater than said first steady state circulating airflow value;

(b.) equipping said control circuit to generate, without changing said firing rate, a second inducer control signal for causing said inducer motor and inducer blower to establish a second steady state combustion airflow value which is greater than said first steady state combustion airflow value;

(c.) establishing, between said second blower and second inducer control signals, a relationship which assures that the temperature at the outlet end of said heat exchanger remains high enough to prevent water from condensing thereon when said circulating airflow is increased from said first to said second steady state circulating airflow value, and (d.) enabling a user to select whether said control circuit generates said first blower and inducer control signals or said second blower and inducer control signals.

2. A method as set forth in claim 1 in which said relationship is such that said temperature remains approximately constant as said circulating airflow changes between said first and second steady state circulating airflow values.

3. A method as set forth in claim 1 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, in which said establishing step comprises the step of establishing, between said second blower control signal and said second inducer control signal, a relationship which assures that the temperatures at the outlet end of the primary heat exchanger and within said coupling box are high enough to prevent water from condensing thereon when said circulating airflow is increased from said first to said second steady state circulating airflow value.

4. A method as set forth in claim 1 in which said furnace is of a type which has a second, high stage firing rate, higher than said first firing rate, a high stage steady state circulating airflow value that is higher than both said first and second steady state circulating airflow values, and a high stage steady state combustion airflow value that is higher than both said first and second steady state combustion airflow values.

5. A method as set forth in claim 4 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, in which said establishing step comprises the step of establishing, between said second blower control signal and said second inducer control signal, a relationship which assures that the temperatures at the outlet end of the primary heat exchanger and within said coupling box are high enough to prevent water from condensing thereon when said circulating airflow is increased from said first to said second steady state circulating airflow value.

6. A method as set forth in claim 4 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second high stage firing rate, including the further step of preventing said control circuit from responding to said high pressure switch during the time that the differential pressure across said heat exchanger is changing as a result of an ignition of said furnace at said first firing rate.

7. A method as set forth in claim 4 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second, high stage firing rate, including the further step of permitting said control circuitry to allow operation for a predetermined time after an ignition of said furnace at said first firing rate.

8. In an apparatus for increasing the circulating airflow of a furnace without creating conditions favorable to the occurrence of cold spot corrosion therein, said furnace being of the type which has a first firing rate, a first steady state circulating airflow value, and a first steady state combustion airflow value, said furnace also being of the type which includes a heat exchanger having an inlet and an outlet, a blower, a blower motor for driving said blower, an inducer blower, an inducer motor for driving said inducer blower, and a control circuit for causing said blower motor and blower to establish said first steady state circulating airflow value, and for causing said inducer motor and inducer blower to establish said first steady state combustion airflow value, the improvement comprising:

an airflow adjusting device connected to said control circuit for enabling a user to selectably increase the circulating airflow of said furnace from said first steady state circulating airflow value to a second, larger steady state circulating airflow value, and to increase the combustion airflow of said furnace from said first steady state combustion airflow value to a second, larger steady state combustion airflow value, without changing said firing rate;

wherein said second steady state combustion airflow value is so related to said second steady state circulating airflow value that the steady state temperature at the outlet of said heat exchanger is maintained at a temperature higher than the condensation temperature of water when the circulating airflow has said second steady state circulating airflow value.

9. An apparatus as set forth in claim 8 in which said second steady state circulating and second steady state combustion airflow values are so related to one another that said temperature remains approximately constant as said circulating airflow changes between said first and second steady state circulating airflow values.

10. An apparatus as set forth in claim 8 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, and in which said second steady state circulating and second steady state combustion airflow values are so related to one another that the temperature at the outlet end of said primary heat exchanger and within said coupling box are high enough to prevent water from condensing thereon when said circulating airflow is increased from said first to said second steady state circulating airflow value.

11. An apparatus as set forth in claim 8 in which said furnace is of a type which has a second, high stage firing rate, higher than said first firing rate, a high stage steady state circulating airflow value that is higher than both said first and second steady state circulating airflow values, and a high stage steady state combustion airflow value that is higher than both said first and second steady state combustion airflow values.

12. An apparatus as set forth in claim 11 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, and in which said second steady state circulating and second steady state combustion airflow values are so related to one another that the temperature at the outlet end of said primary heat exchanger and within said coupling box are high enough to prevent water from condensing thereon when said circulating airflow is increased from said first to said second steady state circulating airflow value.

13. An apparatus as set forth in claim 11 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second high stage firing rate, further including disabling means for preventing said control circuit from responding to said high pressure switch during the time that the differential pressure across said heat exchanger is changing as a result of an ignition of said furnace at said first firing rate.

14. An apparatus as set forth in claim 11 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second, high stage firing rate, further including a switching device for preventing said control circuitry from responding to said high pressure switch for a predetermined time after an ignition of said furnace at said first firing rate.

15. In an apparatus for increasing the circulating airflow of a furnace without creating conditions favorable to the occurrence of cold spot corrosion therein, said furnace being of the type which has a first firing rate, a first steady state circulating airflow value, and a first steady state combustion airflow value, said furnace also being of the type which includes a heat exchanger having an inlet and an outlet, a blower, a blower motor for driving said blower, an inducer blower, an inducer motor for driving said inducer blower, and a control circuit for generating a first blower control signal that causes said blower motor and blower to establish said first steady state circulating airflow value, and for generating a first inducer control signal that causes said inducer motor and inducer blower to establish said first steady state combustion airflow value, the improvement comprising:

manually operable control means for causing said control circuit to apply to said blower motor a second blower control signal which causes said blower to establish a second steady state circulating airflow value that is greater than said first steady state circulating airflow value, and to apply to said inducer motor a second inducer control signal which causes said inducer blower to establish a second steady state combustion airflow value that is greater than said first steady state combustion airflow value, without changing said firing rate;

wherein said second circulating and second combustion airflow values are so related to one another that the temperature at the outlet end of said heat exchanger remains high enough to prevent water from condensing thereon when said circulating airflow is increased from said first to said second steady state circulating airflow value.

16. An apparatus as set forth in claim 15 in which said second steady state circulating and second steady state combustion airflow values are so related to one another that said temperature remains approximately constant as said circulating airflow changes between said first and second steady state circulating airflow values.

17. An apparatus as set forth in claim 15 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, and in which said second steady state circulating and second steady state combustion airflow values are so related to one another that the temperature at the outlet end of said primary heat exchanger and within said coupling box are high enough to prevent water from condensing thereon when said circulating airflow is increased from said first to said second steady state circulating airflow value.

18. An apparatus as set forth in claim 15 in which said furnace is of a type which has a second, high stage firing rate, higher than said first firing rate, a high stage steady state circulating airflow value that is higher than both said first and second steady state circulating airflow values, and a high stage combustion airflow value that is higher than both said first and second steady state combustion airflow values.

19. An apparatus as set forth in claim 18 in which said furnace is of a type in which said heat exchanger includes a primary heat exchanger having an inlet and an outlet, a secondary heat exchanger having an inlet and an outlet, and a coupling box disposed between the outlet of said primary heat exchanger and the inlet of said secondary heat exchanger, and in which said second steady state circulating and second steady state combustion airflow values are so related to one another that the temperature at the outlet end of said primary heat exchanger and within said coupling box are high enough to prevent water from condensing thereon when said circulating airflow is increased from said first to said second steady state circulating airflow value.

20. An apparatus as set forth in claim 18 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second high stage firing rate, further including disabling means for preventing said gas valve from responding to said high pressure switch during the time that the differential pressure across said heat exchanger is high enough to actuate said high pressure switch when said furnace is at said first firing rate.

21. An apparatus as set forth in claim 18 in which said furnace is of a type which includes a first, low pressure switch, connected in differential pressure sensing relationship to said heat exchanger, for causing said furnace to operate at said first firing rate, and a high pressure switch, connected in differential pressure sensing relationship to said heat exchanger, for causing said furnace to operate at said second, high stage firing rate, further including control logic for preventing said control circuitry from responding to said high pressure switch for a predetermined time after an ignition of said furnace at said first firing rate.

* * * * *